United States Patent [19]

Bérubé

[11] Patent Number: 4,498,396

[45] Date of Patent: Feb. 12, 1985

[54] 2.75 INCH PLASTIC WARHEAD

[75] Inventor: Gilles Bérubé, Loretteville, Canada

[73] Assignee: Her Majesty the Queen in right of Canada, as represented by the Minister of National Defence, Ottawa, Canada

[21] Appl. No.: 357,288

[22] Filed: Mar. 11, 1982

Related U.S. Application Data

[63] Continuation of Ser. No. 87,237, Oct. 22, 1979, abandoned.

[30] Foreign Application Priority Data

Mar. 1, 1979 [CA] Canada ..... 322792

[51] Int. Cl.[3] ..... F42B 13/22

[52] U.S. Cl. ..... 102/529; 102/517

[58] Field of Search ..... 102/501, 444, 498, 506, 102/529, 517

[56] References Cited

U.S. PATENT DOCUMENTS

| | | |
|---|---|---|
| 2,986,091 | 5/1961 | Ferguson . |
| 3,440,963 | 4/1969 | DeLuca . |
| 3,765,336 | 10/1973 | Kulsik . |
| 3,902,683 | 9/1975 | Bilsbury . |
| 4,109,579 | 8/1978 | Carter . |

*Primary Examiner*—Harold J. Tudor

*Attorney, Agent, or Firm*—Stevens, Davis, Miller & Mosher

[57] ABSTRACT

The invention disclosed relates to an inexpensive practice warhead for use in conjunction with combat rockets. The novel warhead is basically the same configuration and weight as conventional metal warheads, but is constructed of an inexpensive plastic material, the weight difference being made up by providing ballast means within the hollow core of the warhead.

6 Claims, 2 Drawing Figures

2.75 INCH PLASTIC WARHEAD

Figure 2:
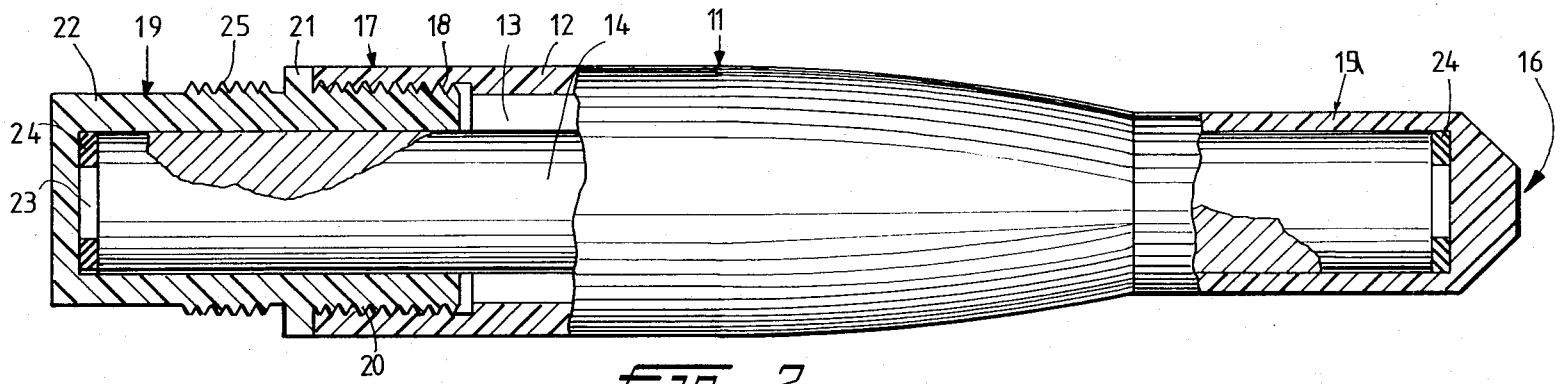

This is a continuation of application Ser. No. 087,237 filed Oct. 22, 1979 now abandoned This invention relates to practice warheads for use in conjunction with air-to-surface rockets and in particular to an inexpensive practice warhead for a 2.75 inch rocket.

Practice warheads are used in the training of personnel in the delivery of air-to-surface rockets. The main requirement of a practice rocket warhead is, of course, to provide a close simulation of the performance of the actual warhead.

In order to provide this close simulation for a rocket propelled warhead, one must consider at least two parameters:

(a) The ballistic coefficient, which affects both the propelled and the unpropelled phase of the flight.

(b) The thrust/weight ratio which affects only the propelled phase of the trajectory.

During the propelled phase of the flight, the forces acting on the rocket-warhead assembly are the thrust (the most important) and the aerodynamic force (to which relate the ballistic coefficient). It is therefore very important to keep the thrust/weight ratio of the practice rocket-warhead assembly similar to the ratio of the combat rocket-warhead assembly. Any change in this ratio would modify the acceleration (F=ma) and of course, the trajectory of the rocket-warhead.

During the unpropelled phase of the flight (free flight), the aerodynamic force and the gravity are the only forces acting on the rocket-warhead assembly and the usual way to match the trajectory of a practice projectile with the trajectory of an actual warhead is to make their ballistic coefficient equal.

The ballistic coefficient may be calculated according to the following relationship:

$$BC = C_d A / W$$

wherein BC is the ballistic coefficient, $C_d$ is the coefficient of drag, A is the maximum cross-sectional area and W is the weight of the projectile.

Moreover, it must be considered that the rocket used in practice is a standard combat rocket. The following conditions therefore apply:

(a) The thrust will be the same in practice as in combat.

(b) The maximum cross-sectional area of the rocket-warhead assembly will be the same in practice as in combat.

These conditions imply that the weight of the practice warhead must be the same as the weight of the combat warhead because if the weight is reduced, the thrust being the same, the acceleration will be greater during the propelled phase of the flight, unless the $C_d$ is considerably increased. If the weight is reduced the $C_d$ is increased, A being the same, the ballistic coefficient will be increased and the practice rocket-warhead assembly will not match the trajectory of the combat rocket-warhead assembly during the unpropelled phase of the flight. The novel practice warhead has the same weight and shape and hence coefficient of drag, as the combat warhead, in order to provide a ballistic match.

Practice warheads currently in use are constructed completely of metal. Metal warheads have become increasingly expensive due to increased manufacturing costs. This is the case with the practice warhead known by the trade designation WTU-1/B, currently employed by the Canadian Forces in training of personnel in the use of MK-151 warheads in conjunction with 2.75 inch rockets.

It is therefore an object of the invention to provide a less expensive practice warhead to replace the WTU-1/B for use with 2.75 inch rockets.

It is proposed to achieve this desired result by employing a less expensive construction material, namely, a suitable light-weight plastic material. Such materials permit the use of simpler and less expensive manufacturing techniques, for example, molding. The expected cost saving is of the order of 20–30%. Various plastic materials presently on the market satisfy both of these criteria.

Unfortunately, one cannot simply replace the metal construction material with a suitable light-weight plastic, since plastic is inherently much lighter than the previously employed metal. Specifically, in order to retain the same ballistic properties as the WTU-1/B, the ballistic coefficient of the novel practice warhead must match that of the WTU-1/B. In order to retain the same ballistic and aerodynamic properties and to avoid any needless replacement or modification of presently used launchers, the proposed novel practice warhead will have approximately the same external configuration i.e. coefficient of drag and maximum cross-sectional area as the WTU-1/B. This is achieved by providing a light-weight shell defining a hollow core. In order to provide the required additional weight to compensate for the use of the lighter plastic material, ballast means is disposed within the hollow core. The ballast means must be appropriately located to ensure the same location of the center of gravity as in the WTU-1/B and to ensure flight stability.

According to the invention, an improved practice warhead is provided for simulating the flight characteristics of an actual warhead, said practice warhead comprising a cylindrical metal body of a low drag external configuration, the coefficient of drag, weight and maximum cross-sectional area of the practice warhead being such that the ballistic coefficient of the practice warhead closely matches that of the actual warhead, the improvement comprising replacing said metal body with a shell of a suitable light-weight plastic material of substantially the same external configuration and maximum cross-sectional area, said shell defining a hollow core, and ballast means disposed in said core to provide sufficient weight to match the ballistic coefficient of the improved warhead with that of the actual warhead while maintaining flight stability.

Figure 1:
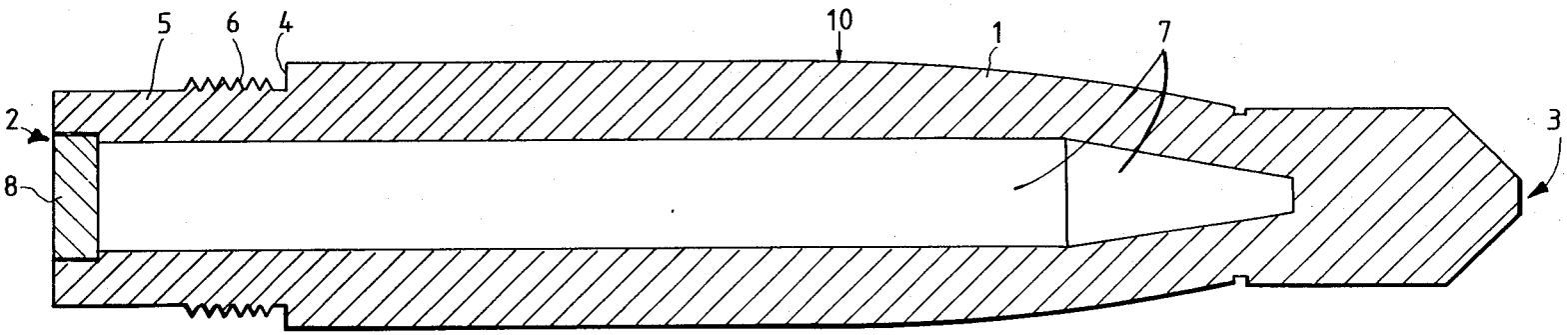
FIG-1 (PRIOR ART)

In the drawings which serve to illustrate embodiments of the invention,

FIG. 1 is a side elevation in section of one embodiment of a prior art 2.75 inch practice warhead, known by the trade designation WTU-1/B, and FIG. 2 is a side elevation in section of a novel 2.75 inch practice warhead according to the present invention.

With reference to FIG. 1, the WTU-1/B practice warhead shown generally as 10, is seen to comprise a cylindrical metal body 1 of a low-drag external configuration exhibited by streamlining from the aft-end 2 to the fore-end 3. The metal body includes a hollow core 7 and an aft-opening conveniently closed by a plug 8. The warhead body includes an integral aft-end joint 5 provided with external threading 6 for attaching the warhead to the internally threaded fore-end of a 2.75 inch rocket. Proper attachment of the warhead to the rocket is achieved when shoulder 4 on the warhead body butts against the fore-end of the rocket (not shown). The largest diameter of the WTU-1/B practice warhead is 2.75 inches at its juncture with the rocket, and its weight is about 9.3 lbs.

Turning now to FIG. 2, the improved practice warhead according to the invention designated generally as 11 is seen to comprise a light-weight shell 12 of a suitable light-weight plastic material. The shell 12 defines a hollow core 13, and ballast means, conveniently in the form of a cylindrical steel rod 14, is disposed in the core 13 to bring the total weigh of the novel warhead up to that of the WTU-1/B i.e. about 9.3 lbs. The steel rod is conveniently made of standard commercial cold finished steel and may be purchased direct from the manufacturer without requiring any machining or other treatment.

The shell 12 is seen to have approximately the same external configuration as the WTU-1/B, having a slightly larger nose diameter 16 and a slightly longer straight nose section 15. The difference in configuration is required to provide sufficient support for the steel rod. The difference in drag is considered to be negligible.

The aft-end 17 of the shell 12 is open and internally threaded at 18 for connection of a joint member 19 which serves to close the opening and connect the practice warhead to the rocket (not shown). The joint 19 comprises a cylindrical shell 22 defining a hollow core 23 and is constructed of the same lightweight plastic material as the shell 12. The joint 19 is of approximately the same internal diameter as the steel rod 14 and thus serves to properly position the rod within the core. The joint 19 is externally threaded at 20 for connection with internal threads 18 on the shell 12. The external diameter of the joint 19 thus approximates the internal diameter of the shell 12. The joint includes a stub 21 which butts against the aft-end 17 of the shell for positioning purposes. In this respect, the rod 14 extends virtually the entire length of the core, with the exception of providing for location of resilient spacers, conveniently neoprene washers 24, which allow for large tolerances and differences in thermal expansion between the steel rod and the plastic shell and joint members. The joint 19 is also externally threaded at 25 for connection to a 2.75 inch rocket body (not shown).

The preferred plastic material for both the shell and joint member is a nylon/fiberglass composition comprising 60–70%/w nylon and 40–30%/w fiberglass, most preferably 70%/w nylon and 30%/w fiberglass.

The plastic components are molded according to conventional injection molding techniques well known to those skilled in the art.

Prior to molding, the plastic composition is coloured in conventional manner, thus eliminating the need for subsequent painting of the practice warhead as is the case with metal warheads. Improved radar tracking capability is achieved if the warheads are painted with an appropriate radar reflextive paint.

It is also contemplated that by replacing the steel rod by an appropriate heavy metal material such as tungsten or depleted uranium, encapsulated into a plastic shell, the warhead could be used as a very effective kinetic energy penetrator.

Tests were conducted to assess the survivability of the novel plastic practice warhead when exposed to the exhaust plume of the preceeding rockets.

SURVIVABILITY TO THE ROCKET PLUME

Since the material used was plastic, i.e. 70% nylon/30% fiberglass, there existed a possibility that this plastic material could melt when exposed to rocket exhaust plume. It was therefore decided to conduct the following trials:

(a) Test set-up and trials

A very simple test set-up was used and its purpose was to simulate the worst condition to which the warhead could be exposed to during the firing. A LAU-5003 rocket launcher was loaded with seventeen (17) live rockets and two (2) inert rockets fitted with 2.75 inch plastic warheads. The seventeen (17) live rockets were ripple fired and the two (2) warheads were exposed to their exhaust. This trial was repeated twice.

(b) Results

Tests indicated that although the warheads were exposed to very severe environment that there was no indication that the warheads underwent any damage other than paint erosion.

It will be appreciated by those skilled in the art that the invention may be embodied in forms other than those described herein without departing from the spirit or central characteristics of the invention. The embodiments described herein are thus to be considered as illustrative and by no means restrictive.

The embodiments of the invention in which an exclusive property or privilege is claimed are defined as follows:

1. A practice warhead for simulating the flight characteristics of an actual warhead, the practice warhead providing a coefficient of drag, weight and maximum cross-sectional area of the practice warhead such that the ballistic coefficient of the practice warhead matches closely that of the actual warhead, the practice warhead comprising a shell of substantially the same external configuration and maximum cross-sectional area as the actual warhead, the shell defining a hollow core, and readily insertable ballast means in the form of a cylindrical metal rod disposed in the core to provide a sufficient weight to match the ballistic coefficient of the actual warhead while maintaining flight stability, the practice warhead being characterised in that the shell is of a suitable plastic material, the cylindrical metal rod being of generally uniform diameter throughout its length, the hollow core of the shell having a forward end portion of substantially the same internal diameter as the outside diameter of the metal rod and within which said metal rod is positioned, the remainder of said hollow core being of greater diameter than said metal rod, said shell including an aft opening of greater diameter than said metal rod for receiving the metal rod within the core, a joint means detachably secured in said aft opening, said joint means being a generally cylindrical member open at one end and having a central hollow bore of the same diameter as said metal rod and within which the aft end of said metal rod is positioned whereby each end portion of the cylindrical metal rod is principally supported adjacent each of its ends and positioned to define an annular space between the metal rod and the core.

2. A practice warhead according to claim 1 further characterised in that said joint means includes external means for connecting the practice warhead to a rocket, said joint means also being of a suitable plastics material.

3. A practice warhead according to claim 1 further characterised in that said joint means is secured within said aft opening of shell by means of screw threads, said external means also comprising screw threads.

4. A practice warhead according to claim 1 or 2 or 3 further characterised by resilient spacers located between the opposing ends of the metal rod and the plastics shell and said joint means to allow for large tolerances and differential thermal expansion between the shell and the metal rod.

5. A practice warhead according to claim 1, 2 or 3, further characterised in that plastics material is a nylon/glass fibre composition comprising 60–70% by weight of nylon and 40–30% by weight of glass fibre.

6. A practice warhead according to claim 1, 2 or 3, further characterised in that the plastics material is a composition comprising 70% by weight of nylon and 30% by weight of glass fibre.

* * * * *